United States Patent [19]

Von Gonten, Jr.

[11] Patent Number: 4,944,349

[45] Date of Patent: Jul. 31, 1990

[54] COMBINATION DOWNHOLE TUBING CIRCULATING VALVE AND FLUID UNLOADER AND METHOD

[76] Inventor: William D. Von Gonten, Jr., 1111 Fannin, Suite 1500, Houston, Tex. 77002

[21] Appl. No.: 316,159

[22] Filed: Feb. 27, 1989

[51] Int. Cl.[5] ..... E21B 37/00

[52] U.S. Cl. ..... 166/304; 166/312; 166/323

[58] Field of Search ..... 166/62, 303, 304, 312, 166/321, 323

[56] References Cited

U.S. PATENT DOCUMENTS

| | | | |
|---|---|---|---|
| 3,085,629 | 4/1963 | Henderson | 166/224 |
| 3,376,936 | 4/1968 | Tomlin | 166/226 |
| 3,542,130 | 11/1970 | Stout | 166/224 |
| 3,627,049 | 12/1971 | Young | 166/314 |
| 4,049,057 | 9/1977 | Hewes | 166/304 |
| 4,257,484 | 3/1981 | Whitley et al. | 166/325 |
| 4,330,039 | 5/1982 | Vann et al. | 166/297 |
| 4,434,854 | 3/1984 | Vann et al. | 166/386 |
| 4,574,894 | 3/1986 | Jadwin | 175/317 |
| 4,645,007 | 2/1987 | Soderberg | 166/374 |
| 4,681,167 | 7/1987 | Soderberg | 166/371 |
| 4,724,908 | 2/1988 | Pringle | 166/317 |
| 4,749,094 | 6/1988 | Skipper et al. | 166/323 |

*Primary Examiner*—William P. Neuder

*Attorney, Agent, or Firm*—Vaden, Eickenroht, Thompson & Boulware

[57] ABSTRACT

A combination circulating valve and fluid unloader adapted for connecting in a tubing string disposed within the well bore of a producing well which is closed to downward flow of fluids therethrough. The valve includes a tubular member with ports through the wall thereof having a sliding sleeve disposed around the outside surface which is also provided with ports through the wall thereof for passage of fluid into the annulus. Opening and closing of the valve is accomplished by shifting the sliding sleeve between three positions by changing the pressure of the fluids contained in the tubing string to overcome the force exerted by a spring biasing the sliding sleeve toward a first, closed position. When the pressure of the fluid is increased to a first selected pressure, the sliding sleeve is shifted with respect to the tubular member to a second, circulating position in which the ports of the tubular member are in fluid communication with the ports of the sliding sleeve. When the pressure is further increased to a second selected pressure, the sliding sleeve is shifted to the third, unloading position in which the ports are also in fluid communication for the passage of fluid without regard to pressure. A spring-biased pin is provided for locking the sliding sleeve in the third position to allow the draining of fluid from the tubing string.

17 Claims, 2 Drawing Sheets

COMBINATION DOWNHOLE TUBING CIRCULATING VALVE AND FLUID UNLOADER AND METHOD

BACKGROUND OF THE INVENTION

The deposition of paraffin on tubing and flow lines is a persistent problem in oil production. Paraffin deposition causes restricted flow of the fluids being produced from the well, increased flow line pressure, and decreased production, and can lead to mechanical problems. Paraffin is generally removed from tubing by mechanical, thermal, or chemical means, each method having various advantages and disadvantages. Mechanical methods rely on the scraping of the paraffin from the surface of the pipe and are, therefore, generally used when the paraffin deposits are not very heavy. Large deposits of paraffin physically obstruct the pipe and prevent the passage of the scraper such that mechanical methods are unsatisfactory for use in that situation.

Chemical methods of treating paraffin include the circulation of various solvents, wax crystal modifiers, and/or paraffin dispersants down the production tubing. However, the paraffin is then carried in the tubing with the fluid all the way to the refinery, and some chemicals are not desirable at the refinery. Further, treatment of the well with chemicals is costly compared to mechanical and thermal treatment, mostly because paraffin removing chemicals are generally fairly expensive.

Thermal methods involve the pumping of hot oil down the well outside of the production tubing and using heat transfer through the production tubing to melt the paraffin on the inside of tubing. After the paraffin inside the tubing is melted, hot oil must be pumped down the flow line to clean the paraffin out of the flow line. However, pumping oil down the outside of the production string and down the inside of the flow line requires a greater quantity of oil and is thus more expensive. Further, heat transfer is not always effective in removing all of the paraffin. Other disadvantages of chemical and thermal methods of paraffin removal are addressed in the specification of U.S. Pat. No. 4,681,167, and that discussion is hereby incorporated into this specification by this specific reference thereto.

There is, therefore, a need for an improved method for removing paraffin deposits from a well, a problem which has been recognized in several previously issued U.S. patents. For instance, U.S. Pat. No. 3,085,629 discloses a control coupling to be inserted into a production string, or tubing, of a type commonly used in the industry just below the point at which paraffin accumulates. The coupling includes a valve having an opening through the wall thereof which is spring-biased to a normally closed position as oil is produced from the well. Introduction of liquid at high pressure, however, opens the spring loaded valve, allowing the passage of the pressurized fluid therethrough once the tubing string has been filled with fluid to produce a sufficient pressure to overcome the tension of the spring.

As described in that patent, downward flow through the production tubing is prevented by a one way valve that is part of the pump located at the bottom of the well and which prohibits fluids in the tubing from flowing down into the strata. As noted in the above-referenced U.S. Pat. No. 4,681,167, such an apparatus does not provide for the unloading, e.g., the draining, of the pressurized fluid which has been introduced into the tubing string to remove the paraffin from the tubing string. Unloading must be accomplished if, for instance, the pump is stuck in the well. Draining a well in which an apparatus such as that disclosed in U.S. Pat. No. 3,085,629 is positioned requires the backing off of the sucker rods off the installation at the pump, pulling the rods, and then swabbing the well to remove the fluid or shooting a hole in the tubing to drain the fluid. Either method is expensive and time consuming.

U.S. Pat. No. 3,085,629 is merely representative of several prior patents that disclose devices which are utilized in a producing well having production installations of a type commonly used in the industry which include sucker rods, a downhole pump, and a tubing string which is closed by a one-way valve in the pump at the bottom of the well but which do not allow the draining of fluid from the tubing. Those patents of which Applicant is aware that describe devices that are characterized by that same limitation are identified by the following numbers: U.S. Pat. Nos. 3,376,936, 4,330,039, 3,542,130, 4,434,854, 4,049,057, 4,645,007, 4,257,484, 4,681,167.

Other disadvantages and limitations of several of the devices disclosed in these patents are characterized in the specification of U.S. Pat. No. 4,357,484, and that discussion is also hereby incorporated into this specification by this specific reference thereto.

In short, and as set out in the specification of U.S. Pat. No. 4,681,167, there remains a long-felt, but unfulfilled, need within the industry for an apparatus which can be selectively shifted between a closed position for producing fluids from a well and an open position for introducing a fluid into a producing well which can also be maintained in the open position to permit draining of the production tubing. The apparatus described in that particular patent has not, in spite of the stated intention of doing so, fulfilled that need. That patent describes a piston valve for positioning in a production installation of the type described above which is shifted to an open position for introducing fluid into the well by increased pressure in the production tubing. An engaging device mounted on the sucker rods which extend down through the valve is provided for subsequently closing the valve by mechanical action. Closing the valve is accomplished from the surface by a pivoting dog mounted on the piston which is selectively pivoted to engage the engaging device. That pivoting dog bears against the outside surface of the engaging device until actuated. Of course, the sucker rods of the production installation continually reciprocate within the valve, and on information and belief, the pivoting dog eventually wears through the engaging device as a result of the constant reciprocation, defeating the alleged reliability of the valve. Further, the device must be manually shifted to the closed position, e.g., does not close when the pressure of the fluid in the tubing is reduced.

The use of fluid pressure changes to open and close a valve is, of course, known in the industry. For instance, U.S. Pat. No. 3,627,049 discloses a device having normally closed, pressure-actuated valves arranged at opposite ends of the tubing string which are adapted to be successively opened. However, that apparatus is adapted for removing contaminates that have previously entered the producing formation following perforation of the casing by sudden change in pressure rather than for circulation of paraffin-removing fluid, and is not conveniently adaptable for removing paraffin from a well. U.S. Pat. No. 4,574,894 discloses a pressure-activated dump valve for use in a downhole motor. Although the device opens and closes in response to the pressure of the fluid in the tubing in which it is located, operation of that device is in a manner opposite the operation required for circulating paraffin-removing fluids in that pressure is required to close rather than to open a fluid flow port.

It can be seen, therefore, that the need for a pressure-operated downhole valve for circulating fluids down into the well for paraffin removal which also allows the draining of fluid from the tubing string in which the valve is located that was recognized in U.S. Pat. No. 4,681,167 still has not been fulfilled. The present invention, however, provides such a valve.

It is, therefore, an object of the present invention to provide a pressure-operated valve for use in a well having a production installation of a type in common use in the industry for circulating fluids through a tubing string for the removal of paraffin from a well and for draining fluids from the well.

It is another object of the present invention to provide a circulating valve which is effective in removing paraffin from a well under a variety of well conditions.

It is another object of the present invention to decrease the cost of removing of paraffin from a well.

Still another object of the present invention is to provide a circulating valve having ports through the wall thereof of different cross-sectional dimensions for maintaining the valve in the open, circulating position as long as the pressure of the fluid in the tubing is maintained above a selected pressure.

It is another object of the present invention to provide a combination circulating valve and tubing unloader, the valve of which does not close in response to pressure decreases, when the pressure of the fluid in the tubing string in which the valve is located exceeds a selected pressure.

It is another object of the present invention to provide a valve which, once opened for draining of fluid from the tubing, remains open regardless of the pressure of the fluid in the tubing.

Other objects, and the advantages of the present invention, will be apparent from the following description of a presently preferred embodiment thereof.

SUMMARY OF THE INVENTION

These objects are accomplished by providing a downhole fluid circulating and unloading valve comprising a tubular member adapted for connecting in a tubing string that is disposable within a well bore. The tubing member is adaptable for use in connection with a number of installations commonly used in the industry and is provided with a port in the wall thereof for passage of fluid out of the tubular member into the annulus between the tubing string and the well bore. A sliding sleeve with a port in the wall thereof is disposed around the outside surface of the tubular member. Means is provided for biasing the sliding sleeve toward a first closed position preventing the circulation of fluid out of the port in the wall of the tubular member through the port in the wall of the sliding sleeve. The sliding sleeve is provided with means responsive to an increase in the pressure of the fluid in the tubular member for shifting the sliding sleeve relative to said tubular member against the force exerted by the biasing means from the first position to a second, open position in which the port in the wall of tubular member is in fluid communication with the port in the wall of the sliding sleeve to allow fluid to pass out of the port in the wall of the tubular member and through the port in the wall of the sliding sleeve into the annulus and then, in response to a further increase in pressure, from said second position to a third, unloading position in which the port in the wall of the tubular member is also in fluid communication with the port in the wall of said sliding sleeve. Means is also provided for locking the sliding sleeve in the third position to allow the draining of fluid from within the tubular member into the annulus without regard to the decrease in the pressure of the fluid within the tubing string which occurs as the fluid drains from the tubular member. The cross sectional diameter of the port in the sliding sleeve is of smaller dimension than the cross sectional diameter of the port in the tubular member, thereby providing a pressure difference, or back pressure, between the ports to maintain the sliding sleeve in the second position when the pressure of the fluid in the tubing string exceeds the first selected pressure.

DETAILED DESCRIPTION OF PREFERRED EMBODIMENTS

Figure 1:
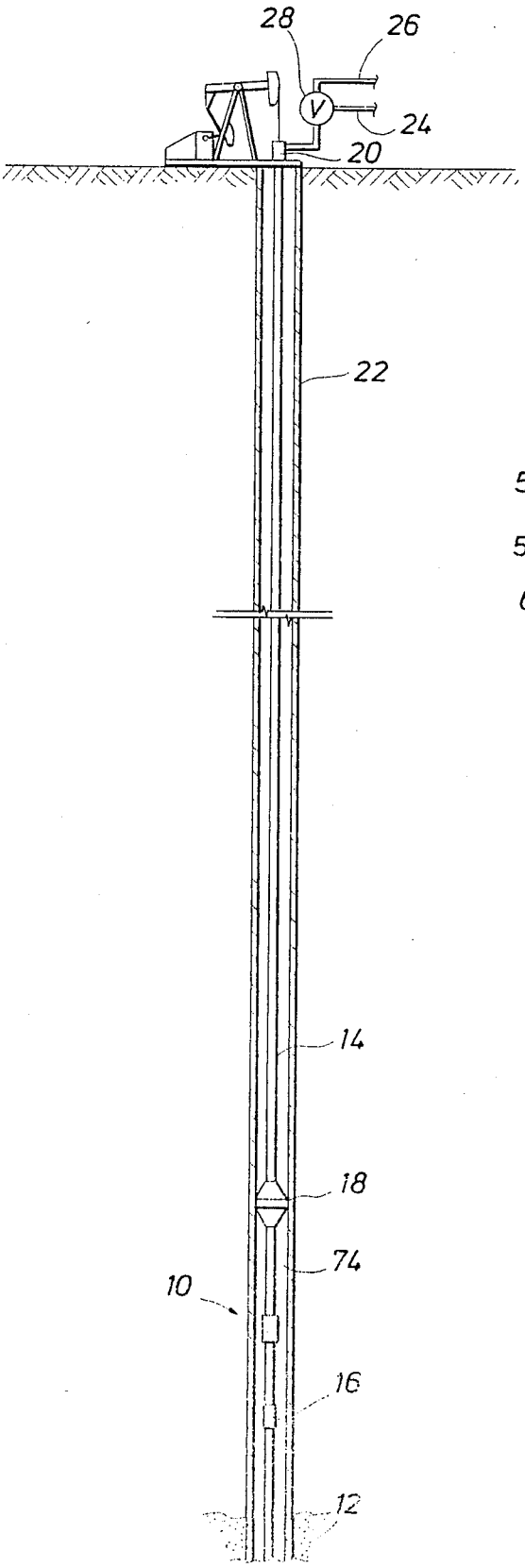
FIG. 1 is a schematic representation of a longitudinal section through a well having the circulating and unloading valva of the present invention positioned therein.

Referring to FIG. 1, there is shown a schematic representation of an oil well having a producing installation positioned therein of a type which is in common use in the industry. The downhole fluid circulating valve and unloader 10 of the present invention is positioned in the tubing string 14 of such an installation above a producing formation, indicated generally at reference numeral 12, having a pump (not shown) located therein, and above a seating nipple 16 of a type known in the art for sealing off the tubing string 14 above the pump from below the pump. As is common in such installations, the pump is provided with a one-way valve (not shown) which prohibits downward flow of fluid through tubing string 14 into the formation 12. The pump can be any type of downhole production pump such as an electric downhole pump or a sucker rod-operated pump, (i.e., an Axelson or Harbison-Fisher pump), as long as the pump is provided with a valve. Although reference has been made to a valve in a pump, those skilled in the art who have the benefit of this disclosure will recognize that the circulating valve and unloader 10 of the present invention could be used in a well which does not include a pump, such as a flowing well, so long as the well is provided with a one-way valve. The circulating valve and unloader 10 is generally positioned below a tubing anchor 18, but will function satisfactorily if positioned above the tubing anchor 18. Those skilled in the art who have the benefit of this disclosure will recognize that alternative installations will also provide opportunity for efficacious use of the circulation valve and unloader 10 of the present invention. For instance, the circulating valve and unloader 10 could be used in a flowing well (having a valve for prohibiting downward flow) with a well packer (not shown) positioned therein. A conventional well head 20 is disposed at the upper end of the well casing 22 having a pipe 24 for passage of production fluids and a pipe 26 for pumping fluid down into the tubing string 14 connected thereto. A valve 28 is provided for selecting the pipe 24 or 26 as is appropriate.

Figure 2:
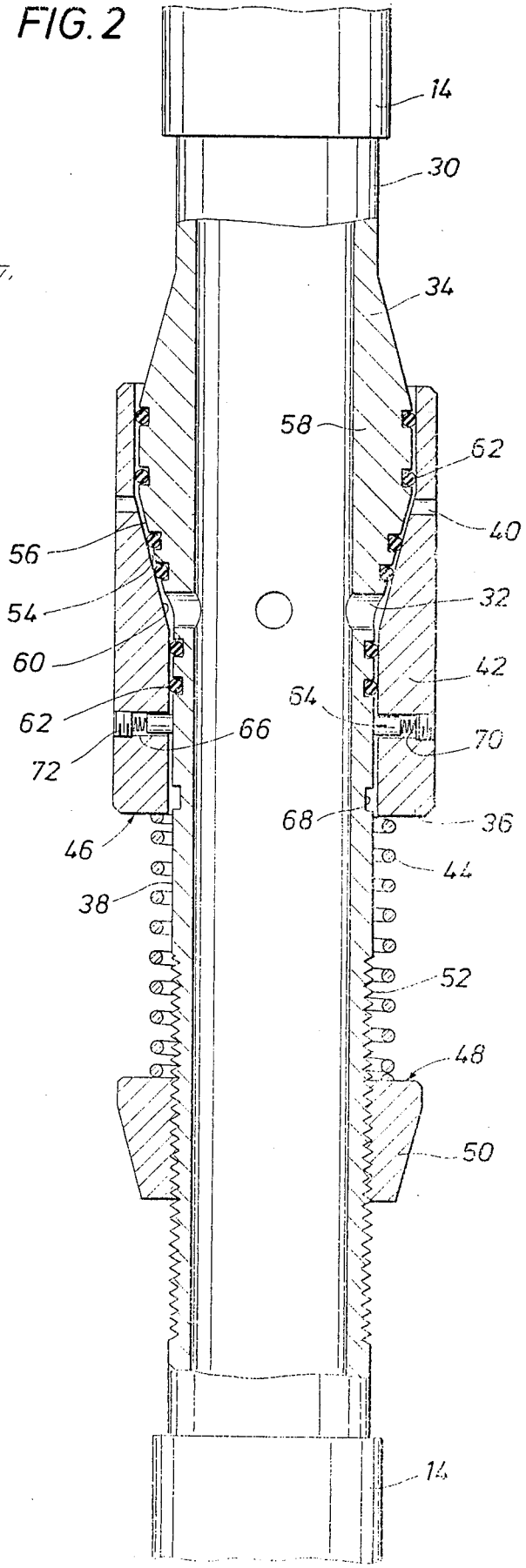
FIG. 2 a longitudinal sectional view of a circulating valve and fluid unloader constructed in accordance with the present invention showing the valve in a first, closed position.

Referring now to FIG. 2, the details of the structure of the circulating valve and unloader 10 are shown. The circulating valve and unloader 10 is comprised of a tubular member 30 adapted for connecting in tubing string 14 as is known in the art and having one or more ports 32 in the wall 34 thereof for passage of fluid out of tubular member 30 as will be described. A tubular sliding sleeve 36 is disposed around the outside surface 38 of tubular member 30 and is provided with one or more ports 40 in the wall 42 thereof, also for passage of fluid, into the annulus between tubing string 14 and the well bore. Means is provided for biasing sliding sleeve 36 toward a first, closed position preventing the circulation of fluid out of the port 32 through the port 40 as shown in FIG. 2 in the form of coil spring 44. One end of spring 44 bears against the surface 46 of sliding sleeve 36 and the second end of spring 44 bears against the surface 48 of nut 50. Nut 50 effectively provides a shoulder on tubular member 30 for capturing spring 44. Nut 50 comprises a means for adjusting the first and second selected pressures at which sliding sleeve 36 is shifted from the first position to second and third positions as will be described and is threadably received on the threads 52 in tubular element 30. The amount of bias, or force, exerted by the spring 44 to bias sliding sleeve 36 toward that first, closed position and hence, the first and second selected pressures, is adjusted by moving nut 50 up and down along tubular member 30 on threads 52.

Figure 3:
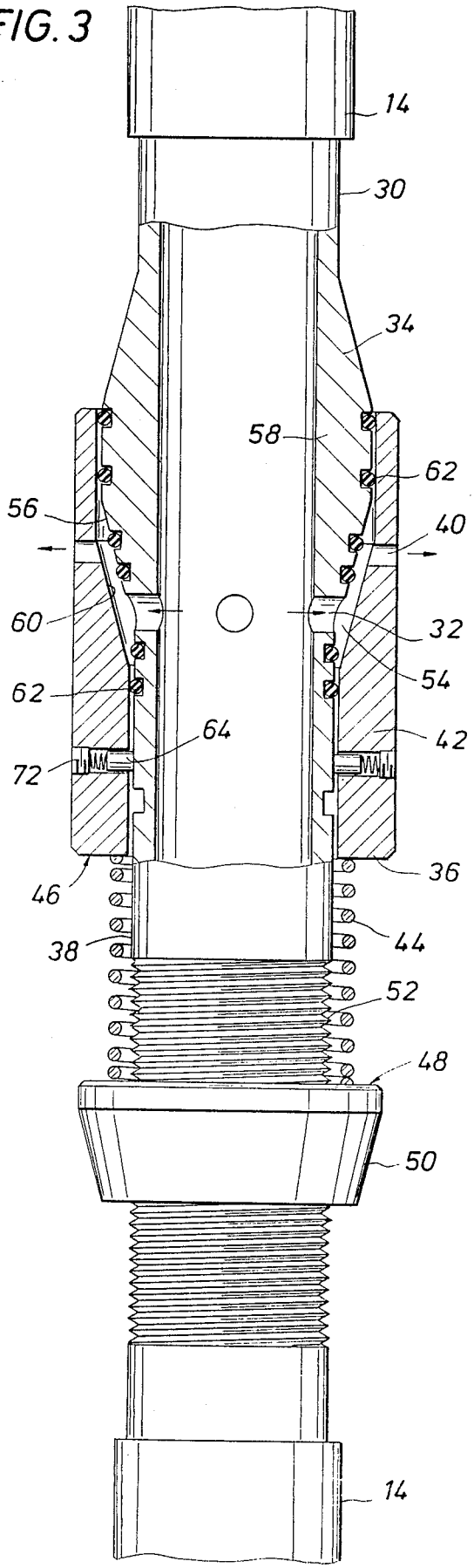
FIG. 3 is a longitudinal sectional view of the apparatus of FIG. 2 shown in a second, circulating position.

Sliding sleeve 36 is provided with means responsive to an increase in the pressure of the fluid in the tubing string 14, and hence, tubular member 30, for shifting sliding sleeve 36 against the force exerted by spring 44 from the first position shown in FIG. 2 to a second, open position as shown in FIG. 3 and then, in response to a further increase in pressure, to a third, unloading position in which port 32 is also in fluid communication with port 40, in the form of the chamber 54 between sliding sleeve 36 and tubular member 30. The chamber 54 is formed by the beveled surface 56 in the enlarged portion 58 of the wall 34 of tubular member 30 and the beveled surface 60 on the inside of sliding sleeve 36. Referring again to FIG. 2, tubular member 30 is provided with sealing means in the form of the O-rings 62 mounted in the grooves (not numbered) on the outside surface 38 thereof for enclosing the chamber 54 between sliding sleeve 36 and tubular member 30.

The beveled surface 60 of sliding sleeve 36 provides a means for translating the force exerted by the fluid accumulated in chamber 54 against sliding sleeve 36 into movement of sliding sleeve 36 relative to tubular member 30 when the pressure of the fluid in chamber 54 is increased to a first selected pressure overcoming the force exerted against sliding sleeve 36 by the biasing means, namely spring 44, to shift sliding sleeve 36 to the second and third positions. As shown in the figures, the total cross sectional diameters of the ports 40 is smaller than the total cross sectional diameters of the ports 32 in the wall 34 of tubular member 30, thereby insuring that a pressure difference, or back pressure, is maintained between the fluid accumulated in the chamber 54 and the fluid contained within tubular member 30 to maintain the sliding sleeve 36 in the second, open position shown in FIG. 3. In that second position, the port 32 through the wall 34 of tubular member 30 is uncovered by the shifting of sliding sleeve 36 relative to tubular member 30, thereby placing the ports 32 in tubular member 30 and the ports 40 in sliding sleeve 36 in fluid communication to allow fluid to circulate through the ports 32 and the ports 40 as shown by the arrows in FIG. 3 into the annulus 74 between tubing string 14 and casing 22. When the pressure of the fluid contained within tubular member 30 is decreased, e.g., when the pump on the pump truck pumping hot oil is backed off, the coil spring 44, which biases sliding sleeve 36 back toward the first, closed position shown in FIG. 2 causes sliding sleeve 36 to tend back toward that first position. However, the back pressure resulting from the different dimensions of ports 32 and ports 40 maintains the sliding sleeve 36 in the second, open position, even when the pressure is decreased, as long as the pressure of the fluid in tubular member 30 is above the first selected pressure. If the pump is backed off enough for the pressure to fall below the first selected pressure, or if the pump is shut off, the sliding sleeve 36 returns to the first, closed position.

Figure 4:
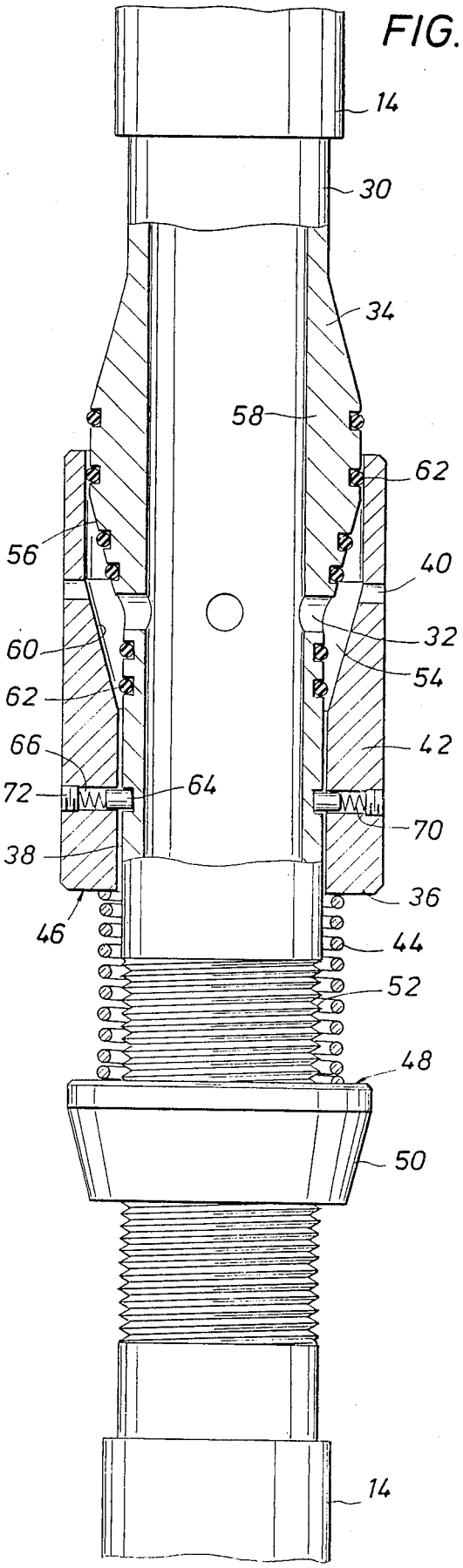
FIG. 4 is a longitudinal sectional view of the apparatus of FIG. 2 shown in a third, unloading position.

When the pressure of the fluid within tubular member 30 is further increased to a second selected pressure, the sliding sleeve 36 is shifted against the bias applied by spring 44 relative to tubular member 30 until the pins 64 mounted in the bore 66 in sliding sleeve 36 are aligned with the respective recesses 68 in the outer surface 38 of tubular member 30. When the pin 64 is aligned with the recess 68, the pin 64 springs into the recess 68 under the influence of the spring 70 which is captured between the pin 64 and a plug 72 threadably received within the bore 66. Until the pin 64 and recess 68 are aligned by the shifting of sliding sleeve 36, the pin 64 bears against the outer surface 38 of tubular member 30. Once the sliding sleeve 36 is positioned in the third, unloading position shown in FIG. 4, the engagement of the recess 68 by pin 64 prevents any subsequent shifting of sliding sleeve 36 with respect to tubular member 30, effectively locking sliding sleeve 36 in the third, unloading position such that the position of sliding sleeve 36 no longer changes in response to changes in the pressure of the fluid within tubular member 30. When it is desired to unlock sliding sleeve 36 from the unloading position shown in FIG. 4, the circulating valve and unloader 10 must be pulled from the well and the plugs 72 backed out of the bores 66 to release the pins 64 from the recess 68.

Having described the circulating valve and unloader 10, reference can be made to the figures for a description of the method of using the circulating valve and unloader 10 to remove paraffin from a well and drain the fluid from the tubing string 14. The circulating valve and unloader 10 is activated by selecting pumping pipe 26 for receiving a paraffin-removing fluid such as hot oil from the pump truck (not shown) with valve 28. Fluid is pumped down the pipe 26 into the tubing string 14 to fill the tubing string 14, the one-way valve in the pump (not shown) preventing passage of fluid out of tubing string 14 into the formation as described above. Continued pumping of the fluid causes the fluid pressure in the tubular member 30 to increase to a first selected pressure, causing sliding sleeve 36 to shift relative to tubular member 30 from the first, closed position shown in FIG. 2 to the second, circulating position shown in FIG. 3. Shifting sliding sleeve 36 to the second position allows passage of fluid out of tubular member 30 through ports 32 into chamber 54 and out of chamber 54 through the ports 40 in sliding sleeve 36 into the annulus 74 outside tubing string 14 and inside casing 22. The circulation of fluid through the circulating valve and unloader 10 is restricted by the decreased total cross-sectional diameter of ports 40 with respect to the total cross-sectional diameter of ports 32 to maintain the first selected pressure in the tubing string 14 when sliding sleeve 36 is in the second position.

To use the circulating valve and unloader 10 as a fluid unloader, the pressure of the fluid in the tubing string 14 is further increased to a second selected pressure. Above that second selected pressure, the pressure responsive means, e.g., chamber 54 and the beveled surface 60 of sliding sleeve 36, shifts the sliding sleeve 36 from the second position shown in FIG. 3 to the third, unloading position shown in FIG. 4 in which the circulating valve and unloader 10 is also open to allow passage of fluid therethrough. When the sliding sleeve 36 is shifted far enough that the pins 64 are aligned with the recesses 68 in tubular member 30, the sliding sleeve 36 is locked in the third position and fluid drains from the tubing string 14 without regard to pressure such that it is not necessary to pressurize the fluid to keep the sliding sleeve 36 in the third position to drain tubing string 14. Of course, the same operation can be performed with the pumping unit on the well in the event that the flow rate of the pump is high enough to provide sufficient pressure to shift the sliding sleeve 36 to the third position.

The first and second selected pressures are selected by changing the amount of bias applied to sliding sleeve 36. Changes are made before running the circulating valve and unloader 10 downhole by turning the nut 50 on threads 52 to move the nut 50 relative to tubular member 30, thereby changing the degree of compression of coil spring 44. Changes can also be accomplished by selecting a coil spring 44 of different bias. Almost every well has a different set of operating conditions such that changes in the first and second selected pressures may be needed to compensate for the depth at which the circulating valve and unloader 10 is positioned, the gravity of the fluid, and the level of the oil in the annulus outside the tubing string 14. It is also preferred that a safety factor be taken into account in selecting the pressures because many wells are pressurized at the surface to check for leaks in the tubing string 14 after a new pump is run down into the well.

Although the invention has been described in terms of the above-illustrated presently preferred embodiment, those skilled in the art who have the benefit of this disclosure will recognize that certain changes can be made to that preferred embodiment without departing from the spirit and scope of the present invention. Such changes and modifications are intended to fall within the purview of the invention as defined in the following claims.

I claim:

1. A downhole fluid circulating and unloading valve comprising:

a tubular member adapted for connection in a tubing string disposable within a well bore that is closed to downward flow of fluid at a point below said tubular member, said tubular member having a port in the wall thereof for passage of fluid out of said tubular member;

a sliding sleeve disposed around the outside surface of said tubular member and having a port in the wall thereof for passage of fluid into the annulus between the tubing string and the well bore;

means for biasing said sliding sleeve toward a first, closed position preventing the passage of fluid out of the port in the wall of said tubular member through the port in the wall of said sliding sleeve;

means on said sliding sleeve responsive to an increase in the pressure of the fluid in said tubular member for shifting said sliding sleeve relative to said tubular member and against said biasing means from said first position to a second, open position in which the port in the wall of said tubular member is in fluid communication with the port in the wall of said sliding sleeve to allow fluid to pass out of the port in the wall of said tubular member and through the port in the wall of said sliding sleeve, and then, in response to a further increase in the pressure of the fluid in said tubular member, from said second position to a third, unloading position in which the port in the wall of said tubular member is also in fluid communication with the port in the wall of said sliding sleeve; and means for locking said sliding sleeve in said third position to allow fluid to drain from within said tubular member into the annulus without regard to the decrease in the pressure of the fluid which occurs as fluid drains from said tubular member.

2. The valve of claim 1 wherein said biasing means comprises a spring having one end bearing against said sliding sleeve and a second end bearing against a shoulder on said tubular member.

3. The valve of claim 2 wherein said shoulder comprises a nut threadably received on the outside surface of said tubular member and the pressures at which said sliding sleeve is shifted to said second and third positions are adjusted by moving said nut up and down along the threads.

4. The valve of claim 1 additionally comprising means for adjusting the pressures at which said sliding sleeve is shifted relative to said tubular member.

5. The valve of claim 1 wherein said locking means comprises a pin mounted in said sliding sleeve, said pin being biased against the outer surface of said tubular member and into a recess in the outer surface of said tubular member when aligned therewith.

6. The valve of claim 1 wherein said pressure responsive means comprises a chamber formed between said tubular member and said sliding sleeve having a surface forming one wall thereof for translating the force exerted by the pressurized fluid accumulated in the chamber into movement of said sliding sleeve relative to said tubular member.

7. The valve of claim 6 wherein said tubular member is provided with sealing means for enclosing the chamber between said sliding sleeve and said tubular member.

8. A combination downhole tubing circulating valve and fluid unloader comprising:

a tubular member adapted for connection in a tubing string disposable within a well bore, the tubing string being closed to downward flow of fluid at a point below said tubular member, and having a port through the wall thereof for the passage of fluid out of said tubular member;

a tubular sliding sleeve mounted on the outer surface of said tubular member to form a chamber therebetween for accumulation of fluid passing through the port in the wall of said tubular member and having a port through the wall thereof for passage of fluid out of the chamber into the annulus between the tubing string and the well bore;

means for biasing said sliding sleeve toward a first, closed position covering the port in the wall of said tubular member to prevent the passage of fluid into the annulus;

means for translating force exerted by the fluid accumulated in the chamber against said sliding sleeve into movement of said sliding sleeve relative to said tubular member when the pressure of the fluid in the chamber is increased to a first selected pressure overcoming the force exerted by said biasing means to shift said sliding sleeve to a second, circulating position in which the port in the wall of said tubular member is uncovered and fluid passes from the chamber through the port in said sliding sleeve into the annulus and then, in response to a further increase in the pressure of the fluid in said tubular member to a second selected pressure, from said second position to a third, unloading position in which the port in the wall of said tubular member is also in fluid communication with the port in the wall of said sliding sleeve; and means for locking said sliding sleeve in said third position to drain said tubular member without regard to the pressure of the fluid as a result of the draining of the fluid into the annulus.

9. The combination circulating valve and fluid unloader of claim 8 additionally comprising means for adjusting said first and second selected pressures at which said sliding sleeve is shifted relative to said tubular member.

10. The combination circulating valve and fluid unloader of claim 8 wherein said force translating means comprises a beveled surface on said sliding sleeve forming one wall of the chamber between said sliding sleeve and said tubular member.

11. The combination circulating valve and fluid unloader of claim 8 additionally comprising sealing means for enclosing the chamber between said sliding sleeve and said tubular member.

12. A method of removing the paraffin from a tubing string in a well having a circulating valve with a sliding sleeve connected therein and then draining the tubing string comprising:

filling the tubing string in the well with a paraffin-removing fluid;

increasing the pressure of the fluid in the tubing string to a first selected pressure to shift the sliding sleeve of the circulating valve connected therein from a first, closed position to a second, circulating position in which the circulating valve is opened to allow passage of fluid into the annulus outside the tubing string;

increasing the pressure of the fluid in the tubing string to a second selected pressure to shift the circulating valve from the second position to a third, unloading position in which the circulating valve is also open to allow passage of fluid therethrough and locked in the third position; and draining the fluid from the tubing string and into the annulus through the circulating valve.

13. The method of claim 12 wherein the valve is biased towards the first position and the fluid pressure is increased to overcome the bias to shift the sliding sleeve at the first and second selected pressures.

14. A downhole fluid circulating and unloading valve comprising:

a tubular member adapted for connecting in a tubing string disposable within a well bore that is closed to downward flow of fluid at a point below said tubular member, said tubular member having a port in the wall thereof for passage of fluid out of said tubular member;

a sliding sleeve disposed around the outside surface of said tubular member and having a port in the wall thereof for passage of fluid into the annulus between the tubing string and the well bore;

a spring having one end bearing against said sliding sleeve and a second end bearing against a nut threadably received on the outside surface of said tubular member for biasing said sliding sleeve toward a first, closed position preventing the passage of fluid out of the port in the wall of said tubular member through the port in the wall of said sliding sleeve;

means on said sliding sleeve responsive to an increase in the pressure of the fluid in said tubular member for shifting said sliding sleeve relative to said tubular member and against said biasing means from said first position to a second, open position in which the port in the wall of said tubular member is in fluid communication with the port in the wall of said sliding sleeve to allow fluid to pass out of the port in the wall of said tubular member and through the port in the wall of said sliding sleeve, and then, in response to a further increase in pressure of the fluid in said tubular member, from said second position to a third, unloading position in which the port in the wall of said tubular member is also in fluid communication with the port in the wall of said sliding sleeve; and means for locking said sliding sleeve in said third position to allow fluid to drain from within said tubular member into the annulus without regard to the decrease in the pressure of the fluid which occurs as fluid drains from said tubular member.

15. A donwhole fluid circulating and unloading valve comprising:

a tubular member adapted for connecting in a tubing string disposable within a well bore that is closed to downward flow of fluid at a point below said tubular member, said tubular member having a port in the wall thereof for passage of fluid out of said tubular member;

a sliding sleeve disposed around the outside surface of said tubular member and having a port in the wall thereof for passage of fluid into the annulus between the tubing string and the well bore;

means for biasing said sliding sleeve toward a first, closed position preventing the passage of fluid out of the port in the wall of said tubular member through the port in the wall of said sliding sleeve;

a chamber formed between said sliding sleeve and said tubular member having a surface forming one wall thereof responsive to an increased in the pressure of the fluid in said tubular member for translating the force exerted by the pressurized fluid accumulated in the chamber into movement of said sliding sleeve for shifting said sliding sleeve relative to said tubular member and against said biasing means from said first position to a second, open position in which the port in the wall of said tubular member is in fluid communication with the port in the wall of said sliding sleeve to allow fluid to pass out of the port in the wall of said tubular member and through the port in the wall of said sliding sleeve, the port in said sliding sleeve being smaller than the port in said tubular member for providing a back pressure on the fluid in the chamber, and then, in response to a further increase in the pressure of the fluid in said tubular member, from said second position to a third, unloading position in which the port in the wall of said tubular member is also in fluid communication with the port in the wall of said sliding sleeve; and means for locking said sliding sleeve in said third position to allow fluid to drain from within said tubular member into the annulus without regard to the decrease in the pressure of the fluid which occurs as fluid drains from said tubular member.

16. A combination downhole tubing circulating valve and fluid unloader comprising:

a tubular member adapted for connecting in a tubing string disposable within a well bore, the tubing string being closed to downward flow of fluid at a point below said tubular member, and having a port through the wall thereof for the passage of fluid out of said tubular member;

a tubular sliding sleeve mounted on the outer surface of said tubular member to form a chamber therebetween for accumulation of fluid passing through the port in the wall of said tubular member and having a port through the wall thereof of smaller cross-sectional diameter than the cross-sectional diameter of the port in the wall of said tubular member for passage of fluid out of the chamber into the annulus between the tubing string and well bore while providing a pressure difference between the fluid in said tubular member and the fluid accumulated in the chamber;

means for biasing said sliding sleeve toward a first, closed position covering the port in the wall of said tubular member to prevent the passage of fluid into the annulus;

means for translating force exerted by the fluid accumulated in the chamber against said sliding sleeve into movement of said sliding sleeve relative to said tubular member when the pressure of the fluid in the chamber is increased to a first selected pressure overcoming the force exerted by said biasing means to shift said sliding sleeve to a second, circulating position in which the port in the wall of said tubular member is uncovered and fluid passes from the chamber through the port in said sliding sleeve into the annulus and then, in response to a further increase in the pressure of the fluid in said tubular member to a second selected pressure, from said second position to a third, unloading position in which the port in the wall of said tubular member is also in fluid communication with the port in the wall of said sliding sleeve; and means for locking said sliding sleeve in said third position to drain said tubular member without regard to the pressure of the fluid as a result of the draining of the fluid into the annulus.

17. A method of removing the paraffin from a tubing string in a well having a circulating valve with a sliding sleeve connected therein and then draining the tubing string comprising:

filling the tubing string in the well with a paraffin-removing fluid;

increasing the pressure of the fluid in the tubing string to a first selected pressure to shift the sliding sleeve of the circulating valve connected therein from a first, closed position to a second, circulating position in which the circulating valve is opened to allow passage of fluid into the annulus outside the tubing string;

restricting the flow of fluid through the circulating valve to maintain the first selected pressure in the tubing string even as fluid passes out of the tubular member;

increasing the pressure of the fluid in the tubing string to a second selected pressure to shift the circulating valve from the second position to a third, unloading position in which the circulating valve is also open to allow passage of fluid therethrough and locked in the third position; and draining the fluid from the tubing string and into the annulus through the circulating valve.

* * * * *